United States Patent [19]

Krekeler

[11] 3,950,031

[45] Apr. 13, 1976

[54] TRIM CHAIN TAKE-UP SPROCKET ASSEMBLY FOR MINING MACHINES AND THE LIKE

[76] Inventor: Claude B. Krekeler, c/o The Cincinnati Mine Machinery Co., 2980 Spring Grove Ave., Cincinnati, Ohio 45225

[22] Filed: May 7, 1975

[21] Appl. No.: 575,378

[52] U.S. Cl. ..... 299/76; 74/242.1 FP; 74/82

[51] Int. Cl.[2] ..... E21C 1/02

[58] Field of Search ..... 299/74, 78, 76, 57, 59, 299/80, 82, 91; 74/243 R, 242.1 FP

[56] References Cited

UNITED STATES PATENTS

| | | | |
|---|---|---|---|
| 2,667,938 | 2/1954 | Cartlidge | 74/243 R X |
| 2,798,712 | 7/1957 | Ball | 299/78 X |
| 3,213,703 | 10/1965 | Fitzgerald | 74/243 R X |
| 3,305,273 | 2/1967 | Kilbourne | 299/76 X |
| 3,581,588 | 6/1971 | Eftefeild | 74/242.1 FP UX |

*Primary Examiner*—Ernest R. Purser
*Assistant Examiner*—William F. Pate, III.
*Attorney, Agent, or Firm*—Melville, Strasser, Foster & Hoffman

[57] ABSTRACT

A trim chain take-up sprocket assembly for a mining machine or the like. The sprocket assembly comprises a pair of opposed and axially aligned spindles constituting mirror images of each other, each spindle having a hub rotatively mounted thereon on suitable bearing means. Each hub has at its outboard end a plurality of sprocket teeth and at its inboard end an annular flange. The hub flanges lie in abutting relationship at the longitudinal center of the sprocket assembly and are detachably joined together. Each spindle at its outboard end has a hydraulically actuable piston-cylinder arrangement adapted to engage an abutment surface on the mining machine whereby the entire sprocket assembly may be shifted longitudinally of the mining machine to take up slack or impart slack to the one or more trim chains engaged by the sprocket assembly. Washer-like spacer means are removably affixable to the pistons of the sprocket assembly to retain the assembly in adjusted position. In another embodiment, the hubs themselves are free of sprocket teeth. The hub flanges are detachably joined to an intermediate sprocket wheel bearing sprocket teeth located at the longitudinal center of the sprocket assembly. In all embodiments the sprocket teeth may be eliminated and an annular flange substituted therefor serving as a roller for the chain engaged thereby.

30 Claims, 10 Drawing Figures

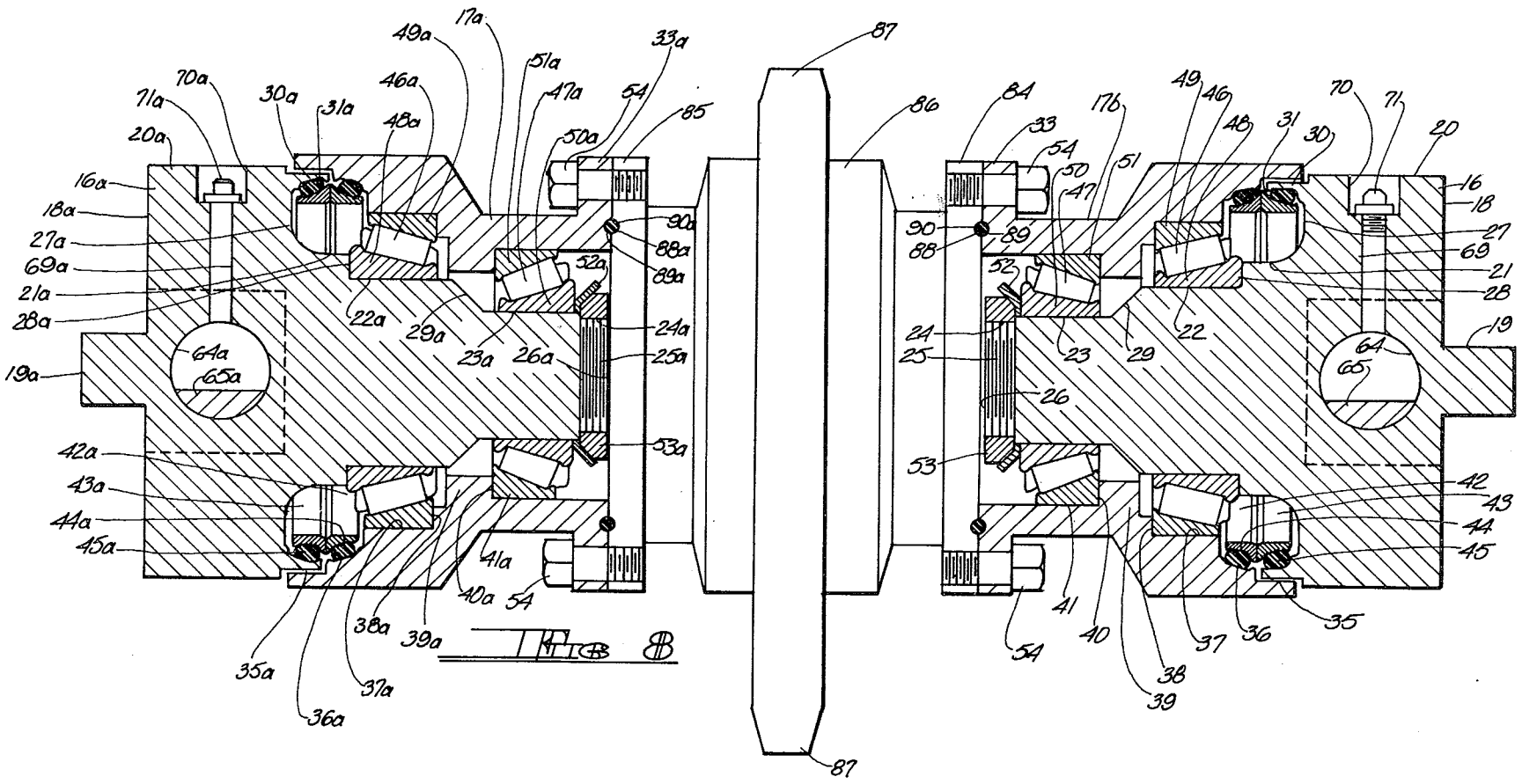
16
18
27
69
21
28
19
20
71
70
64
65
42
43
44
45
35
36
37
38
39
40
41
54
30
31
46
48
49
22
29
17b
51
47
50
23
26
33
84
89
52
24
25
53
90
88
86
87
87
33a
85
90a
88a
89a
24a
25a
53a
54
50a
52a
51a
47a
26a
17a
23a
41a
40a
49a
29a
39a
46a
48a
22a
38a
37a
31a
36a
30a
35a
70a
64a
65a
71a
20a
16a
18a
27a
69a
21a
28a
19a
42a
43a
44a
45a

TRIM CHAIN TAKE-UP SPROCKET ASSEMBLY FOR MINING MACHINES AND THE LIKE

BACKGROUND OF THE INVENTION

1. Field of the Invention

The invention relates to a sprocket assembly for mining machines and the like, and more particularly to an adjustable sprocket assembly by which slack may be imparted to or taken up in the one or more chains engaged by the sprocket assembly.

2. Description of the Prior Art

The sprocket assembly of the present invention may have many uses in situations wherein it is desirable to provide an adjustable sprocket assembly to take up or impart slack in one or more chains engaged by the sprocket assembly. For purposes of an exemplary showing, the sprocket assembly of the present invention will be described in its use on a non-oscillating drum-type mining machine having one or more trim chains.

A typical non-oscillating drum-type mining machine comprises a self-propelled vehicle having a centrally located conveyor means for the material being mined. At the forward end of the machine one or more movable beams support a horizontally oriented cutting drum. The cutting drum bears a plurality of cutting tools usually oriented on the cutting drum in a pattern comprising two oppositely oriented helices which are directed toward the center of the drum. This aids in conducting the cut material toward the center of the mining machine and the conveyor forming a part thereof.

Through appropriate drive mechanism and gearing, in association with the beam or beams, the drum is caused to rotate about its axis to produce a cutting action. In the usual practice, the machine is brought to the face of the material being cut and the drum is sumped into the face of the material at the top thereof. Thereafter, through the agency of the beam or beams, the rotating drum is caused to move downwardly, making a complete vertical cut at the face of the material. This procedure is repeated and the mine entry is thereby advanced.

At the position or positions where the drum is supported on one or more beams, the drum cannot carry cutting tools. Therefore, one or more trim chains are required to fill in these one or more positions. The typical trim chain comprises an endless chain made up of cutting tool carrying links and connecting links. The cutting tools are so arranged on the chain as to cut clearance for that portion of the drum not provided with cutting tools.

While not always the case, the trim chains are driven by sprocket means in association with the drum and pass about an idler sprocket assembly mounted on the mining machine at the other end of the trim chain flight.

During its assembly on or removal from the mining machine, it is necessary that a trim chain be slack. In addition, during continued use, the chain links and pintles joining them become worn causing the effective length of the chain to increase. It is therefore necessary that the mining machine have some means to provide and to take up slack in the one or more trim chains mounted thereon. To this end, prior art workers have developed a number of types of adjustable idler sprockets supporting the one or more trim chains at the rearward end of the chain flight.

For example, in a mining machine of the type having two supporting booms and a trim chain for each boom, prior art workers have developed a sprocket assembly comprising a non-rotating shaft. The shaft ends terminate in portions supported in ways in the mining machine body. The shaft extends transversely of the mining machine body and substantially parallel to the cutting drum. The shaft is slidable in its supporting ways longitudinally of the mining machine (i.e. toward and away from the cutter drum) whereby slack may be purposely introduced into or taken up from the trim chains supported by the sprocket assembly.

A sprocket is rotatively mounted adjacent each end of the shaft on suitable bearing means. Each sprocket supports one of the two trim chains and constitutes an idler sprocket therefor. The central portion of the shaft, between the two sprockets, passes through a housing. A cylinder and piston are oriented at right angles to the shaft axis. The forward end of the piston is adapted to contact the shaft at its longitudinal center. When grease under pressure is introduced into the cylinder, it will cause the piston to shove the shaft and entire sprocket assembly rearwardly of the mining machine in the supporting ways. When the desired adjusted position of the sprocket assembly has been attained, it is usual to pin the shaft ends in the ways so as to lock the sprocket assembly in its adjusted position.

In other embodiments, prior art workers have used screw-down means to contact the center of the shaft of the sprocket assembly to shift the sprocket assembly to a desired adjusted position.

These prior art adjustable sprocket structures have been characterized by certain inherent deficiencies. First of all, since the sprocket assembly during adjustment is shoved rearwardly at its longitudinal center, it tends to teeter about the piston or screw-down means engaging it. This makes precise adjustment of the sprocket assembly difficult. In addition, the sprocket assembly can skew which, in time, will cause the seals of the sprocket assembly to fail and the bearings thereof to become worn. Furthermore, the pins locking the ends of the shaft of the sprocket assembly in the ways are loaded in shear which again is undesirable and may result in failure of the pins.

The present invention is directed to an adjustable sprocket assembly which, unlike prior art structures, may be assembled from its center so that the adjustment means for shifting the sprocket assembly to its desired position may be located at the outboard ends of the sprocket assembly. This enables precise adjustment of the sprocket assembly for the removal of trim chain slack and eliminates uncontrollable teeter or skewing of the assembly. To hold the assembly in its desired adjusted position, the present invention contemplates the use of washer-like spacer means which are loaded in compression and not subjected to shear stresses. The sprocket assembly of the present invention is hydraulically actuated, simple in construction and may be designed to carry one or more trim chains, and one or more sets of sprocket teeth, all as will be described hereinafter.

SUMMARY OF THE INVENTION

The take-up sprocket assembly of the present invention comprises a pair of opposed and axially aligned spindles constituting mirror images of each other. A pair of identical and interchangeable hubs are provided, one of which is rotatively mounted on each spindle on suitable bearing means. Means are provided to releasably join the hubs together with the spindles in axial alignment.

Each spindle at its outboard end has a hydraulically actuated piston-cylinder arrangement adapted to engage an abutment surface on the body of the mining machine whereby the entire sprocket assembly may be shifted rearwardly of the mining machine to take up slack in the one or more trim chains engaged by the sprocket assembly. Washer-like spacer means are removably affixable to the pistons of the sprocket assembly to retain the assembly in the desired adjusted position.

In one embodiment, each hub has at its outboard end a plurality of sprocket teeth and at its inboard end an annular flange. Once each hub has been mounted on its respective spindle, the hub flanges may be brought into abutting relationship at the longitudinal center of the sprocket assembly and may be detachably joined together. In another embodiment of the invention, the hubs themselves are free of sprocket teeth. The hub flanges are detachably joined to an intermediate member located at the longitudinal center of the sprocket assembly. The intermediate member bears a plurality of sprocket teeth so that, in this embodiment, a single set of sprocket teeth are presented at the longitudinal center of the sprocket assembly.

When the outboard ends of the hubs are provided with sprocket teeth, the sprocket teeth of each hub may engage one of two separate trim chains on the mining machine. Alternatively, depending upon the nature of the mining machine, the sprocket teeth of each hub may engage the same single wide, trim chain, all as will be described hereinafter.

Finally, the outboard ends of the hubs may be provided with annular flanges rather than sprocket teeth, the annular flanges engaging the ends of the chain pintles and serving as rollers therefor.

BRIEF DESCRIPTION OF THE DRAWINGS

FIG. 8 is an elevation view, partly in cross section, illustrating another embodiment of the sprocket assembly of the present invention.

FIG. 9 is a perspective view of a hub provided with an annular flange serving as a roller to engate the chain, rather than sprocket teeth.

DESCRIPTION OF THE PREFERRED EMBODIMENTS

Figure 1:
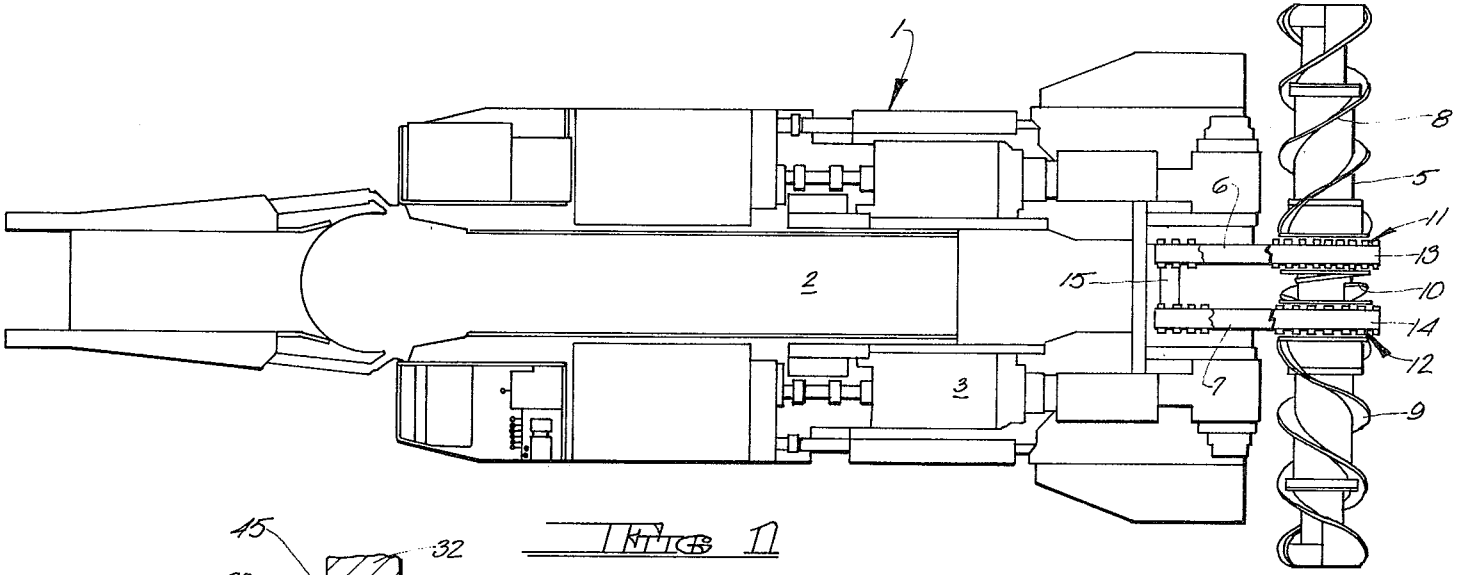
FIG. 1 is a plan view of an exemplary non-oscillating drum-type mining machine utilizing a pair of trim chains.
Figure 4A:
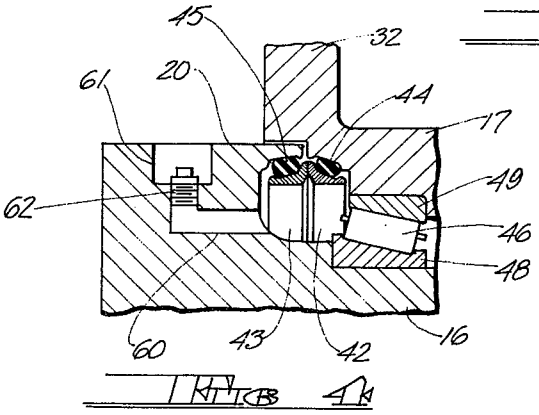
FIG. 4 is a fragmentary cross sectional view taken along the section line 4—4 of FIG. 3.

For a complete understanding of the invention, reference is first made to FIG. 1 illustrating an exemplary continuous mining machine generally indicated at 1 and provided with a longitudinally extending conveyor means 2. The mining machine has a body portion 3 which is usually mounted on wheels or treads and is normally self-propelled. At the forward end of the mining machine a rotatable cutting drum is shown at 5. In the exemplary embodiment illustrated, the cutting drum is supported on the machine frame or body 3 by a pair of beams which are fragmentarily shown at 6 and 7. The beams 6 and 7 are hingedly affixed to the machine body so that they may, through the agency of hydraulic means not shown, raise and lower the cutting drum 5.

The cutting drum 5 will bear a plurality of cutter bits and mounting means therefor, as is well known in the art. At both ends of the drum 5 the cutter bits are arranged in helical patterns so as to direct the material they cut toward the center of the forward portion of the mining machine. Additional means not shown will direct the cut material to the conveyor 2. A helical arrangement of cutter bits is diagrammatically shown at one end of the drum 5 and is indicated by index numeral 8. Similarly, a helical arrangement of cutter bits at the other end of the drum is diagrammatically illustrated at 9. Additional cutter bits are indicated at 10 serving that portion of the drum between beams 6 and 7.

It will be evident from FIG. 1 that at those points (generally indicated at 11 and 12) where the cutting drum 5 is rotatively mounted on the ends of beams 6 and 7, respectively, it would not be possible to mount cutter bits on the drum. Nevertheless, some cutting means must be provided at the areas 11 and 12, or the mining machine could not function. To this end, trim chains 13 and 14 ride over beams 6 and 7, respectively, and pass about the cutting drum 5 at the areas 11 and 12. At the rearward end of their flights, the chains 13 and 14 pass over a sprocket assembly, diagrammatically indicated at 15. As will be evident to one skilled in the art, trim chains 13 and 14 carry cutter bits and will cut clearance for the portions 11 and 12 of cutting drum 5.

In the usual operation of such a mining machine, the cutting drum is raised to an upper position and sumped into the face of the material being cut. Through the agency of beams 6 and 7, the drum 5 is then caused to be lowered, essentially vertically, cutting away at the face of the material being mined. In this way, a mine entry is formed and advanced.

Trim chains, per se, are old and well known in the art. For example, U.S. Pat. No. 3,679,265 teaches a number of embodiments of trim chains. It will be evident from FIG. 1 that in order to install trim chains 13 and 14 or to remove them for purposes of repair and replacement it is necessary to shift sprocket assembly 15 in such a way as to diminish the distance between it and drum 5 so as to create slack in chains 13 and 14. Once the chains are installed, it is necessary to shift sprocket assembly 15 longitudinally of the mining machine so that the distance between it and cutting drum 5 is increased to take up slack in the chains. During the mining operation, the individual links of chains 12 and 14 and the pintle means joining them are subject to wear. Such wear effectively increases the length of chains 13 and 14 creating slack in them. It is therefore necessary that sprocket assembly 15 be additionally shiftable so as to further increase the distance between it and drum 5 in order to take up this chain slack resulting from wear. It is to the provision of an improved adjustable sprocket means 15 that the present invention is directed.

Figure 2:
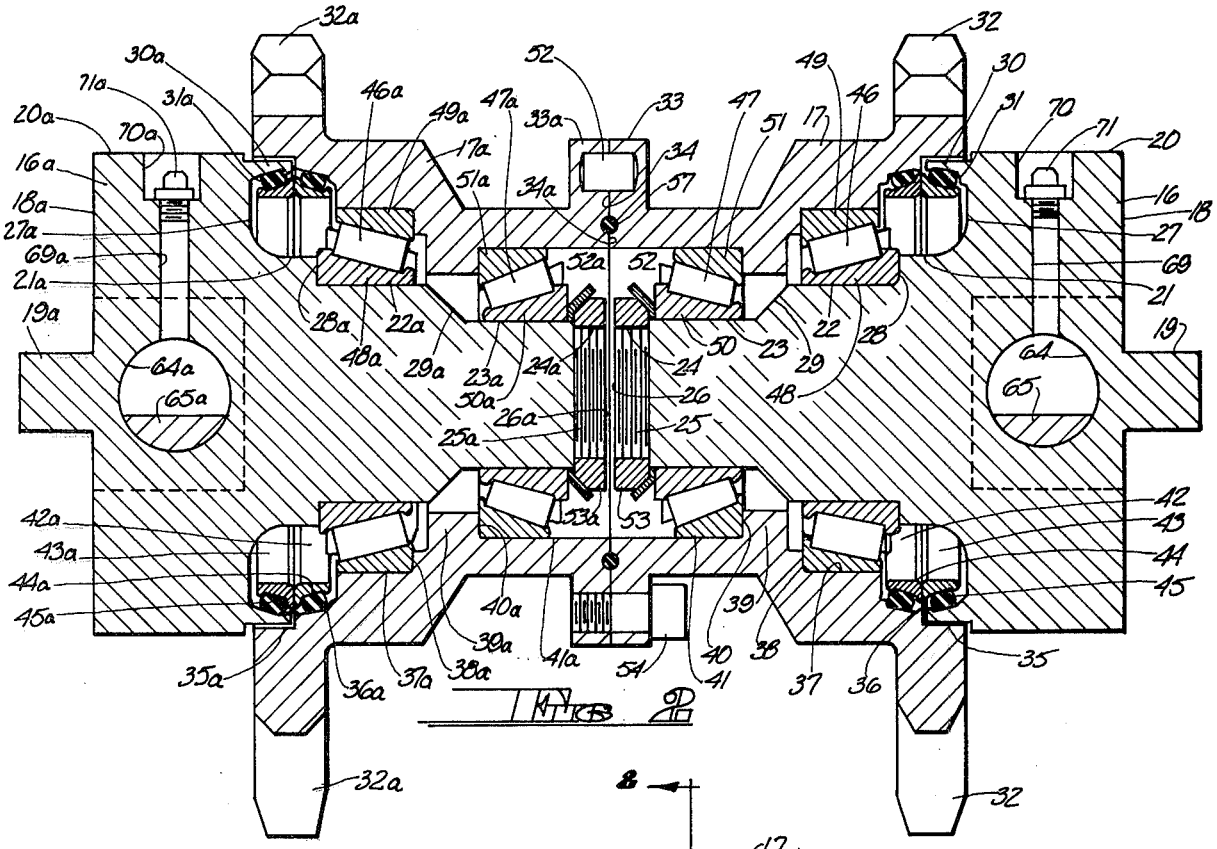
FIG. 2 is a cross sectional elevational view of one embodiment of the sprocket assembly of the present invention, taken along section line 2—2 of FIG. 3.

One embodiment of the sprocket means of the present invention is illustrated in FIGS. 2 through 7. Reference is first made to FIG. 2 constituting a longitudinal cross sectional view of the adjustable sprocket assembly. The assembly comprises four major parts, a first spindle 16, a second spindle 16*a*, a first hub 17 and a second hub 17*a*.

The first spindle 16 is a generally cylindrical member terminating at its outside end in a flat, substantially planar surface 18 bearing a lug 19 (see FIG. 3) adapted to ride in a way in the mining machine body, as will be described hereinafter. A first portion of the spindle 16 provides a circular peripheral surface 20. Second, third, fourth and fifth portions of the spindle provide circular peripheral surfaces 21, 22, 23 and 24 of diminishing diameter. The portion having peripheral surface 24 is exteriorly threaded as at 25 and terminates in a flat surface 26. A planar annular shoulder 27 is formed between surfaces 20 and 21 and another planar annular shoulder 28 is formed between surfaces 21 and 22. A tapered shoulder 29 is located between surfaces 22 and 23. Finally, the shoulder 27 bears an annular rim 30, the inside surface 31 of which is slightly tapered so as to constitute a sealing surface, as will be described hereinafter.

Figure 3:
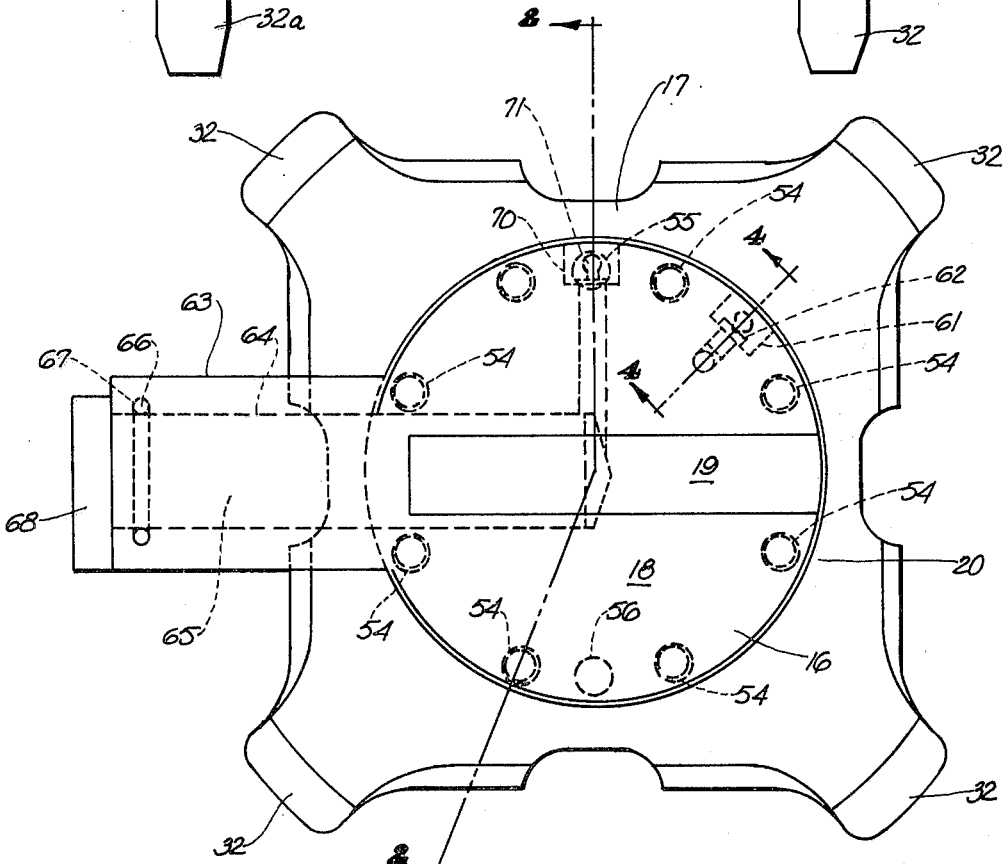
FIG. 3 is an end elevational view of the sprocket assembly embodiment of FIG. 2 as seen from the right of that figure.

The hub 17 is a generally cylindrical, hollow member bearing at its outside end a plurality of sprocket teeth 32 (see FIG. 3). At its inner end, the hub 17 terminates in an annular flange 33 and a planar annular surface 34.

Interiorly, hub 17 has a first interior surface 35 of a diameter slightly greater than the exterior surface of flange 30 on spindle 16. A slightly tapered interior surface 36 corresponds to the interior surface 31 of flange 30 on spindle 16 and serves as a sealing surface, as will be described hereinafter. Interior cylindrical surface 37 lies opposite the surface 22 of spindle 16 and terminates in a planar shoulder 38. An interior annular rim 39 on hub 17 provides a shoulder 40. The shoulder 40 lies adjacent the interior cylindrical surface 41 which extends to the planar end surface 34 of the hub 17 and lies opposite cylindrical surface 33 of spindle 16.

The spindle 16*a* is a mirror image of spindle 16 and is otherwise substantially identical. For this reason, like parts and surfaces of spindle 16*a* have been given the same index numeral as the parts and surfaces of spindle 16, followed by *a*. Hub 17*a* is identical and in fact interchangeable with hub 17. As a consequence, the parts and surfaces of hub 17*a* have been given the same index numeral as the parts and surfaces of hub 17 followed by *a*.

The assembly of the hub 17 on the spindle 16 is accomplished from the end 26 of the spindle. And for purposes of this explanation, reference is made to both FIG. 2 and FIG. 6, FIG. 6 constituting an exploded view of the structure of FIG. 2. As will be described hereinafter, the space between hubs 17 and 17*a* and spindles 16 and 16*a* will be filled with a lubricating oil and it is therefore necessary to form a fluid-tight seal between hubs 17 and 17*a* and between each hub and its respective spindle. A fluid-tight seal between hub 17 and spindle 16 may be accomplished by any appropriate sealing means. For purposes of an exemplary showing, this seal is illustrated as being accomplished by a pair of cone rings 42 and 43 and a pair of resilient toric rings 44 and 45. Toric ring 44 makes a seal between cone ring 42 and interior surface 36 of hub 17. Similarly, toric ring 45 makes a seal between cone ring 43 and the interior surface 31 of spindle flange 30. Sealing means of this type are well known.

The hub 17 is rotatively mounted on spindle 16 by means of a pair of tapered roller bearings 46 and 47. The cone 48 of bearing 46 has a press fit with respect to surface 22 of spindle 16 and abuts spindle shoulder 28. The cup 49 of bearing 46 has a press fit on the interior surface 37 of hub 17 and abuts hub shoulder 38. In similar fashion, the cone 50 of bearing 47 has a press fit on surface 23 of the spindle 16. The cup 51 of bearing 47 has a press fit on the interior surface 41 of hub 17 and abuts hub shoulder 40. Cone 50 of bearing 47 abuts lock washer 52 held in place by nut 53 engaged on threaded portion 25 of spindle 16. It will be understood by one skilled in the art that bearing 46 will prevent a shift of hub 17 with respect to spindle 16 to the right as viewed in FIG. 2. Similarly, bearing 47 will prevent a shift of hub 17 with respect to spindle 16 to the left as viewed in FIG. 2.

Hub 17*a* is mounted on spindle 16*a* in the same manner described with respect to hub 17 and spindle 16. Again, like parts have been given like index numerals followed by *a*. Thus, a seal is effected between hub 17*a* and spindle 16*a* by cone rings 42*a* and 43*a* and toric rings 44*a* and 45*a*. Hub 17*a* is rotatively supported on spindle 16*a* by means of tapered roller bearings 46*a* and 47*a*.

Hubs 17 and 17*a* are joined directly together by means of a plurality of cap screws 54 passing through hub flanges 33 and 33*a* (see also FIG. 3 wherein cap screws 54 are indicated in broken lines). To assist in this assembly, a pair of dowel pins may be provided to more easily align the flange perforations through which cap screws 54 extend. Dowel pins 55 and 56 are indicated in broken lines in FIG. 3. Dowel pin 55 is shown in FIG. 2. As is most clearly seen in FIG. 2, a fluid-tight seal between hub flanges 33 and 33*a* is achieved by means of an O-ring 57 located in cooperating annular notches 58 and 59 in abutting hub surfaces 34 and 34*a*.

Figures 4, 5, 6, 7, 10:
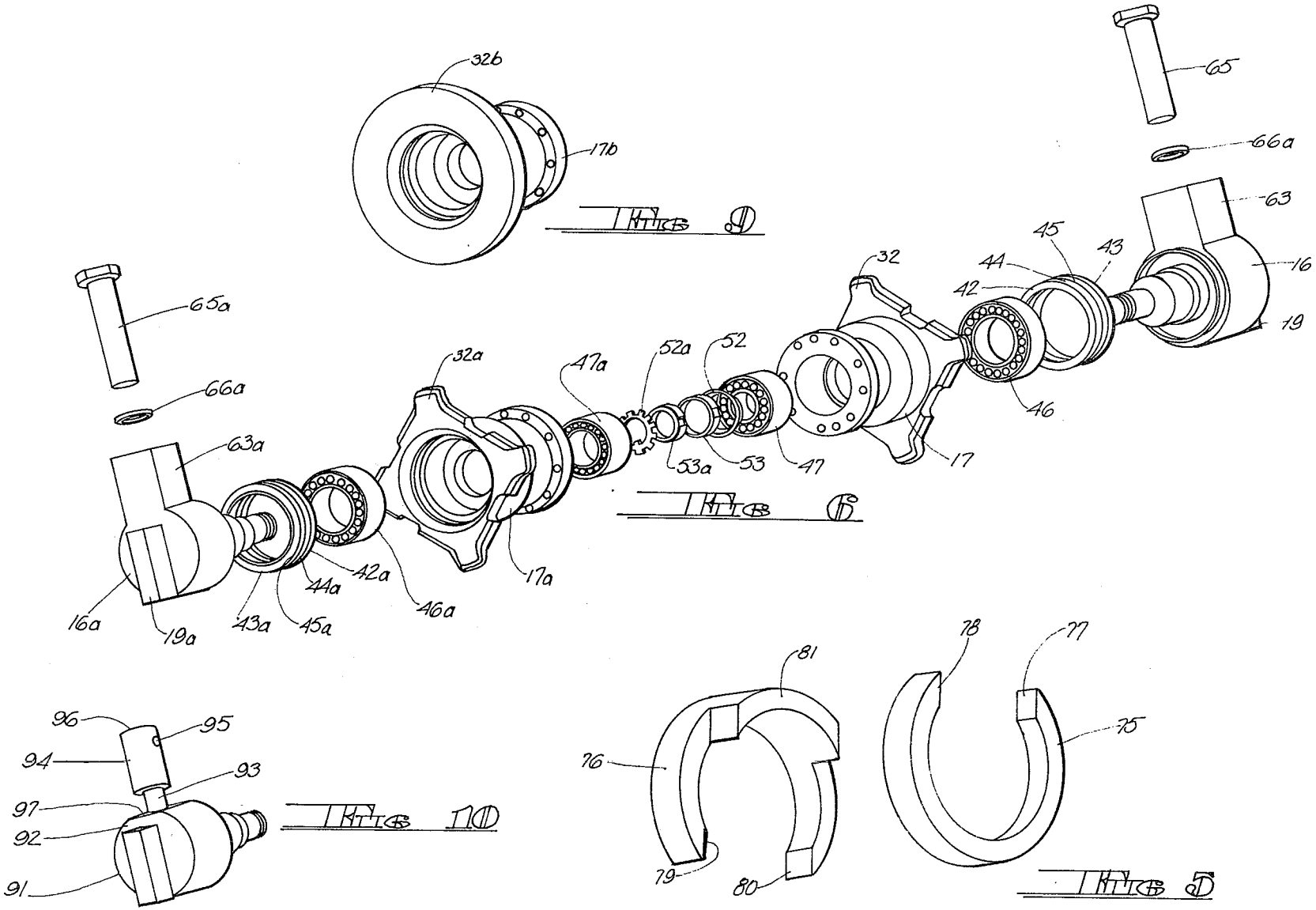
FIG. 5 is an exploded perspective view of a pair of cooperating washer-like split ring spacer means of the present invention.
FIG. 6 is an exploded view of the sprocket assembly of FIG. 2.
FIG. 7 is a fragmentary plan view illustrating the sprocket assembly of the present invention mounted in ways in a mining machine.
FIG. 10 is a perspective view of a spindle similar to those shown in FIGS. 2, 3, 4, 6, 7 and 8 provided with a modified piston-cylinder arrangement.
Figure 7:
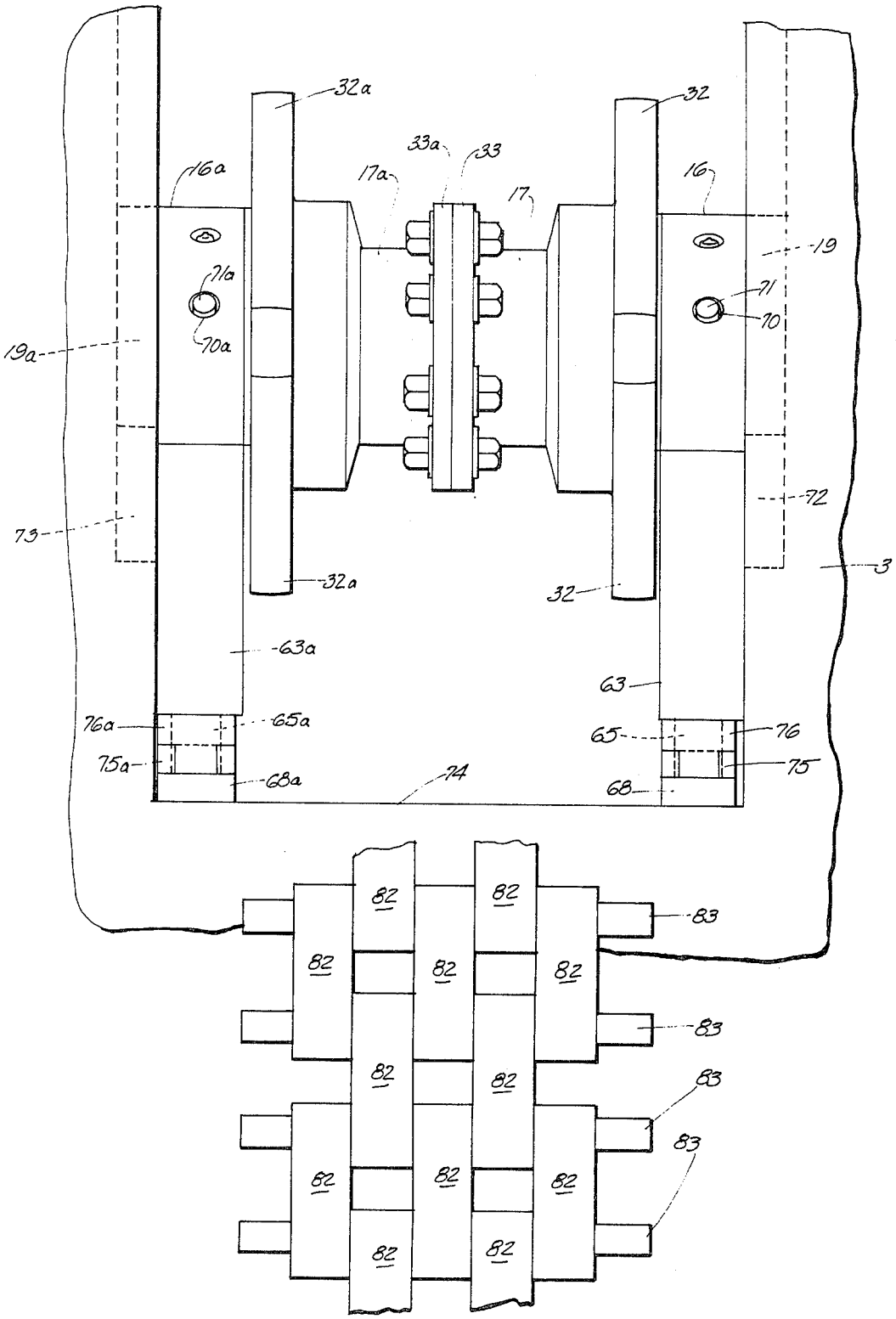

As indicated above, hub flanges 33 and 33*a* are sealed together with a fluid-tight seal and a fluid-tight seal is provided between the hubs and their respective spindles so that the space between the hubs and their respective spindles may be filled with a lubricating oil. To this end, the spindles are provided with filling ports. The filling port of spindle 16*a* is identical to that of spindle 16. The filling port of spindle 16 is shown in FIGS. 3 and 4. Turning to FIG. 4, filling port 60 is shown extending between a depression 61 in the surface 20 of spindle 16 and the space between spindle 16 and hub 17. A closure means 62 is provided for filling port 60.

Since the entire sprocket assembly of FIG. 2 is assembled from its longitudinal center, the outboard ends of spindles 16 and 16*a* are free to be provided with means whereby the sprocket assembly may be shifted so as to adjust the distance between it and the cutting drum 5

(Fig. 1). Turning again to FIGS. 2 and 3, spindle 16 is provided with a lateral extension 63. A bore 64 passes through the lateral extension 63 and into the body of spindle 16. The bore 64 constitutes a cylinder and is adapted to slidingly receive a piston 65. A fluid-tight sealing engagement is made between piston 65 and cylinder 64 by means of O-ring 66 located in annular notch 67 on the inside surface of cylinder 64. Piston 65, at its free end, is provided with a foot 68.

Piston 65 is adapted to be shifted to the left (as viewed in FIG. 3) in cylinder 64 by any appropriate fluid means such as hydraulic fluid. To this end, a bore 69 is provided in spindle 16 extending between a depression 70 in spindle surface 20 and the rearward end of cylinder 64. The bore 69 is provided with a conventional hydraulic fluid fitting 71. The spindle 16*a* is provided with identical adjustment means and like parts have been given like index numerals followed by *a*.

FIG. 7 is a fragmentary view of the body 3 of the mining machine illustrating the sprocket assembly of the present invention mounted thereon. The frame 3 has a pair of opposed ways 72 and 73 adapted to slidingly receive the lug 19 of spindle 16 and the lug 19*a* of spindle 16*a*, respectively. The extension 63 of spindle 16 and the extension 63*a* of spindle 16*a* face toward a surface 74 of the mining machine body 3. The feet 68 and 68*a* of pistons 65 and 65*a* are adapted to be in abutting relationship with mining machine surface 74, as shown.

The ways 72 and 73 in the mining machine body are of such length that when the sprocket assembly pistons 65 and 65*a* are in their fully retracted positions and when piston feet 68 and 68*a* are in abutment with surface 74, the distance between the sprocket assembly and the cutting drum 5 will be such as to provide sufficient slack in trim chains 13 and 14 to permit their assembly on or removal from the mining machine. Once trim chains 13 and 14 are in place, the introduction of hydraulic fluid through fittings 71 and 71*a* will shift pistons 65 and 65*a* within their respective cylinders. As pistons 65 and 65*a* advance within their respective cylinders and because of the abutment of piston feet 68 and 68*a* against the surface 74 of the mining machine body, the entire sprocket assembly will shift away from surface 74 taking up any undesired slack in chains 13 and 14. In similar fashion, additional shifting of the sprocket assembly can be accomplished to take up additional slack in the chains due to wear thereof during the mining operation.

To maintain the sprocket assembly in the desired adjusted position, the present invention contemplates the provision of split metal rings which may be located by a simple blow on pistons 65 and 65*a*. For purposes of an exemplary showing, a pair of split metal rings 75 and 76 are shown mounted on piston 65. An identical pair of split metal rings 75*a* and 76*a* are shown mounted on piston 65*a*. The split metal rings 75 and 76 lie between piston foot 68 and spindle extension 63. Similarly, split metal ring 75*a* and 76*a* lie between piston foot 68*a* and spindle extension 63*a*. The forces acting upon the sprocket assembly will place the split metal rings in compression, but they will not be subjected to shear forces.

Many appropriate split metal rings may be used for the purpose described. The thickness of the split metal rings should be such as to provide convenient and typical increments of adjustment. FIG. 5 is an exploded view illustrating a pair of cooperating split metal rings. Split metal ring 75 has an internal diameter substantially equal to the diameter of the piston 65 or 65*a*. The ends 77 and 78 of split metal ring 75 are separated from each other by a distance less than the diameter of piston 65 or 65*a* so that once the split metal ring is forced onto the piston, it is captively held thereon. The split metal ring may be removed from the piston by an appropriate tool which will spread ends 77 and 78 by a sufficient amount to release the split metal ring from the piston.

Split metal ring 76 of FIG. 5 is substantially identical to split metal ring 75 and its ends 79 and 80 bear the same relationship with respect to each other. Split metal ring 76 differs from split metal ring 75 in that it has an integral arcuate lug 81 which corresponds in length and thickness to the missing segment of split metal ring 75.

In the use of split metal rings of the type illustrated in FIG. 5, it will be understood that only rings of the type shown at 75 in FIG. 5 may be used. Alternatively, a split metal ring 75 may first be used. When an additional split metal ring is required, a split metal ring similar to ring 76 of FIG. 5 will next be used. The lug 81 on split metal ring 76 will fill in the gap of split metal ring 75 so that the compressive forces between the spindle extension and the piston foot can be more equally distributed. For a next adjustment, a split metal ring of the type shown at 75 will be used, followed thereafter by the use of a split metal ring of the type shown at 76, as required. To take full advantage of equal distribution of compressive forces, a split ring 75 may first be used, all additional split rings added being of the type shown at 76 in FIG. 5.

In FIG. 1 a mining machine of the type requiring two trim chains 13 and 14 is illustrated. It will be understood in comparing FIGS. 1 and 7 that hubs 17 and 17*a* are freely rotatable on their respective spindles 16 and 16*a* so as to constitute idler sprockets for the chains. Chain 13 will be engaged by teeth 32 of hub 17 and chain 14 will be engaged by teeth 32*a* of hub 17*a*.

As mentioned heretofore, the cutting drums of some mining machines are supported by one wide beam rather than two individual beams. Under these circumstances, a single wide trim chain is generally required. Such wide chains may take various forms. The above mentioned U.S. Pat. No. 3,679,265 teaches an exemplary form of wide chain. This form of wide chain is diagrammatically illustrated in FIG. 7 and comprises a plurality of groups of links 82, selected ones of which bear cutting means (not shown). The groups of links are arranged with the link ends in interdigitated position and joined together by pintles 83 passing through coaxial perforations in the interdigitated link ends. As illustrated in FIG. 7, the wide chain will pass over the sprocket assembly with sprocket teeth 32 and 32*a* engaging the ends of selected ones or all of the pintles 83. Depending upon the width of the chain, the teeth 32 and 32*a* of the sprocket assembly could engage the ends of selected ones of the links 82, rather than pintles 83.

In some mining machines, a single wide trim chain is used, adapted to be engaged by a single driven sprocket at the drum end of the chain and a single idler sprocket at the rearward end of the chain. The sprocket teeth engage selected ones of the centermost links of the wide chain, if the chain is of the type illustrated in FIG. 7. In other wide chain constructions wherein the cutter bit carrying links extend the full width of the chain and are joined together by connecting links, the sprocket teeth engage the cutter bit carrying links at their centers.

The sprocket assembly of the present invention may be provided in an embodiment presenting a single set of sprocket teeth at its longitudinal center. Such an assembly is illustrated in FIG. 8.

In the embodiment of FIG. 8, the spindles may be identical to those illustrated in FIG. 2 and like parts have been given like index numerals. The hubs 17*b* and 17*c* are substantially the same as hubs 17 and 17*a*, respectively, of FIG. 2 and again like parts have been given like index numerals. Hubs 17*b* and 17*c* of FIG. 8 differ from hubs 17 and 17*a* of FIG. 2 in that they do not carry teeth 32 and 32*a*, respectively, at their outboard ends. The sealing of hub 17*b* to its spindle 16 and the mounting of hub 17*b* thereon are identical to that described with respect to FIG. 2. The same is, of course, true of hub 17*c* and spindle 16*a*. The primary difference between the embodiment of FIG. 8 and the embodiment of FIG. 2 lies in the fact that the hub flanges 33 and 33*a* are not joined directly together, but rather are joined to flanges 84 and 85 of a sprocket wheel 86 bearing sprocket teeth 87. The joinder of hubs 17*b* and 17*c* to the sprocket wheel flanges 84 and 85 may again be accomplished by cap screws 54.

It is desirable in the embodiment of FIG. 8 to provide a fluid-tight seal between flange 33 of hub 17*b* and flange 84 of sprocket wheel 86. This may be accomplished by providing an O-ring 88 in cooperating annular notches 89 and 90 in flanges 33 and 84, respectively. The same type of seal may be provided between flange 33*a* of hub 17*c* and flange 85 of sprocket wheel 86 in the same manner and like parts have been given like index numerals followed by *a*. The operation and the adjustment of the sprocket assembly of FIG. 8 is identical to that described with respect to the embodiment of FIG. 2. The outermost edges of the single wide chain may be supported by and stabilized by the outboard ends of hubs 17 and 17*a*.

In all of the embodiments of the present invention it is possible to substitute an annular rim or flange for the sprocket teeth, each annular flange serving as a roller for the chain passing thereabout. In the embodiment illustrated in FIGS. 2 through 4, 6, and 7, the sprocket teeth 32 on hub 17 and the sprocket teeth 32*a* on hub 17*a* may be replaced by annular rims. This is illustrated, for example, in FIG. 9 wherein a hub similar to hub 17*a* of FIG. 6 is shown at 17*b* provided with an annular rim 32*b* rather than sprocket teeth 32*a*. Hub 17*b* is in all other ways identical to hub 17*a*. It will be appreciated that hub 17 may be similarly modified.

In an instance such as is illustrated in FIG. 7 wherein the assembly of the present invention is adapted to engage a wide chain, if the hubs 17 and 17*a* of FIG. 7 were to be replaced by hubs of the type shown at 17*b* in FIG. 10 the ends of the pintles 83 would engage and pass about the annular rims on the hubs. The outboard links 82 of the chain would abut the facing surfaces of the annular rims keeping the chain properly centered.

Rim or flange bearing hubs may be used when the assembly of the present invention is adapted to be engaged by two individual chains. Means in association with the assembly or in association with the chains would be required to maintain the chains properly centered with respect to the annular flanges about which they pass.

In the embodiment illustrated in FIG. 8, it would be within the scope of the present invention to substitute an annular rim or flange similar to that illustrated at 32*b* in FIG. 9 for the sprockets 87 on wheel 86. Again means would be provided in association with the assembly or the chain to maintain the chain properly centered with respect to the flange about which it passes.

Finally, it would within the scope of the present invention to substitute spindles of the type shown at 91 in FIG. 10 for the spindles 16 and 16*a* of any of the previously described embodiments. The spindle 91 may be substantially identical the spindle 16*a* of FIGS. 2, 4, 6, 7 and 8 and its mirror image counterpart 16 with the exception that the body portion 92 is provided with a laterally extending, fixed piston 93 rather than the extension 63*a* or 63. A cylinder 94 is slidably mounted on fixed piston 93. The cylinder 94 will be provided with appropriate means (such as O-ring 66 of FIG. 3) to have a fluid-tight sealing engagement with fixed piston 93. A conventional hydraulic fluid fitting 95 will be located in cylinder 94 whereby hydraulic fluid or other appropriate fluid may be introduced into or removed from the interior of cylinder 94 causing it to shift away from or toward said spindle body 92. The free end 96 of cylinder 94 is adapted to contact the above described abutment surface 74 of the mining machine body. In this way cylinder 94 serves the same purpose as piston 65*a* or 65 with the end 96 of the cylinder 94 serving the same purpose as piston foot 68*a* or piston foot 68.

To maintain the sprocket assembly of the present invention in a desired adjusted position, rings of the type illustrated at 75 and 76 in FIG. 5 are again used, being mounted as desired on piston 93 between the adjacent end of cylinder 94 and the body 92 of spindle 91. To this end the spindle body 92 may be provided with a flat surface 97 about piston 93 to provide an abutment surface for rings 75 and 76. The rings 75 and 76 may be applied in any of the ways described above.

Modifications may be made in the invention without departing from the spirit of it.

The embodiments of the invention in which an exclusive property or privilege is defined as follows:

1. An adjustable trim chain idler assembly for taking up slack in the at least one trim chain of a mining machine of the type having an elongated body, a cutting drum at the forward end of said body and extending transversely thereof, said cutting drum being rotatably mounted on the end of at least one beam affixed to said body and being shiftable vertically by said beam and at least one trim chain to cut clearance for that portion of said cutting drum rotatably supported on said at least one beam, said idler assembly comprising a pair of spindles, each of said spindles having an inboard end and an outboard end, said spindles being in coaxial, opposed relationship with their inboard ends facing each other, a pair of hubs each having an inboard end and an outboard end, each of said hubs being rotatably mounted on one of said spindles, means for releasably maintaining each of said hubs on its respective one of said spindles, means releasably joining said inboard ends of said hubs, said hubs supporting at least one chain engaging means for said at least one trim chain, means on the outboard ends of said spindles for mounting said idler assembly on said mining machine body transversely thereof and shiftable longitudinally thereof, means at the outboard ends of said spindles for shifting said sprocket assembly longitudinally of said mining machine to increase the distance between said idler assembly and said cutting drum to take up slack in said at least one trim chain and means to maintain said idler assembly in any desired adjusted position with respect to said cutting drum.

2. The structure claimed in claim 1 wherein each of said hubs is rotatably mounted on its respective spindle by means of a pair of oppositely oriented bearings.

3. The structure claimed in claim 1, wherein each of said hubs is rotatably mounted on its respective spindle by means of a pair of oppositely oriented tapered roller bearings.

4. The structure claimed in claim 1 wherein said spindles are mirror images of each other.

5. The structure claimed in claim 1 wherein said hubs are identical.

6. The structure claimed in claim 1 wherein each of said hubs bears a set of radially oriented sprocket teeth, said sets of sprocket teeth comprising said chain engaging means, said inboard ends of said hubs being releasably joined together by fastening means.

7. The structure claimed in claim 1 including a sprocket wheel coaxial with said spindles and located between said inboard spindle ends, said inboard ends of said hubs being releasably joined to said sprocket wheel, said sprocket wheel bearing radially oriented sprocket teeth, said sprocket teeth comprising said chain engaging means.

8. The structure claimed in claim 1 wherein each of said means at the outboard end of each of said spindles for shifting said idler assembly comprises a cylinder and a piston therein, one of said cylinder and said piston being slidable with respect to the other between a fully retracted position and a fully extended position, said slidable one of said cylinder and piston having a free end configured to engage an abutment surface on said mining machine, and means for introducing a fluid into said cylinders whereby to shift said idler assembly.

9. The structure claimed in claim 1 wherein each of said hubs bears an annular flange serving as a roller for said at least one chain, said inboard ends of said hubs being releasably joined together by fastening means.

10. The structure claimed in claim 1 including a wheel coaxial with said spindles and located between said inboard spindle ends, said inboard ends of said hubs being releasably joined to said wheel, said wheel bearing an annular flange serving as a roller for said at least one chain.

11. The structure claimed in claim 1, including means to make a fluid-tight seal between said inboard ends of said hubs, means to make a fluid-tight seal between each of said hubs and their respective spindles near the outboard ends of said hubs and means to introduce a fluid lubricant between said hubs and their respective spindles.

12. The structure claimed in claim 8 wherein each of said pistons is fixed to said outboard end of its respective spindle and its respective cylinder is slidable thereon between said fully retracted and fully extended positions, said means to maintain said idler assembly in adjusted position comprising at least one split ring affixed to each piston between said cylinder thereon and said spindle end mounting said piston.

13. The structure claimed in claim 8, wherein each of said cylinders comprises a part of its respective spindle and said pistons are slidable within their respective cylinders between said fully retracted and fully extended positions, said free ends of said pistons each terminate in an enlarged foot, said means to maintain said idler assembly in adjusted position comprises at least one split ring affixed to each piston between said foot of said piston and the forward end of said cylinder mounting said piston.

14. The structure claimed in claim 12 including first and second types of split rings for use with each piston, said first type comprising a split ring having planar parallel faces, a width between said face representing a convenient increment of adjustment, an internal diameter equal to the diameter of said pistons and ends spaced from each other by a distance slightly less than said diameter of said pistons, said second type comprising a split ring identical to said first type and including an integral arcuate lug adapted to fit between said ends of said first type and being of a thickness equal to the width of said first type whereby when more than one split ring is required for each piston a ring of the first type is first applied to each piston followed by a ring of the second type to more equally distribute compressive forces applied to said rings by the adjacent ones of said piston feet and cylinder forward ends.

15. The structure claimed in claim 13 including first and second types of split rings for use with each piston, said first type comprising a split ring having planar parallel faces, a width between said faces representing a convenient increment of adjustment, an internal diameter equal to the diameter of said pistons and ends spaced from each other by a distance slightly less than said diameter of said pistons, said second type comprising a split ring identical to said first type and including an integral arcuate lug adapted to fit between said ends of said first type and being of a thickness equal to the width of said first type whereby when more than one split ring is required for each piston a ring of the first type is first applied to each piston followed by a ring of the second type to more equally distribute compressive forces applied to said rings by the adjacent ones of said piston feet and cylinder forward ends.

16. In combination a mining machine comprising an elongated body, a cutting drum at the forward end of said body and extending transversely thereof, said cutting drum being rotatably mounted on the end of at least one beam affixed to said body and being shiftable vertically by said beam and at least one endless trim chain passing about and cutting clearance for that portion of said cutting drum rotatably supported on said at least one beam, and an adjustable idler assembly for said trim chain comprising a pair of spindles, each of said spindles having an inboard end and an outboard end, said spindles being in coaxial, opposed relationship with their inboard ends facing each other, a pair of hubs each having an inboard end and an outboard end, each of said hubs being rotatably mounted on one of said spindles, means for releasably maintaining each of said hubs on its respective one of said spindles, means releasably joining said inboard end of said hubs, said hubs supporting at least one chain engaging means for said at least one trim chain, means for mounting said idler assembly on said mining machine body transversely thereof and shiftable longitudinally thereof, means at the outboard ends of said spindles for shifting said idler assembly longitudinally of said mining machine to increase the distance between said idler assembly and said cutting drum to take up slack in said at least one trim chain and means to maintain said idler assembly in any desired adjusted position with respect to said cutting drum.

17. The structure claimed in claim 16 wherein each of said hubs is rotatably mounted on its respective spindle by means of a pair of oppositely oriented bearings.

18. The structure claimed in claim 16, wherein each of said hubs is rotatably mounted on its respective spindle by means of a pair of oppositely oriented tapered roller bearings.

19. The structure claimed in claim 16 wherein each of said hubs bears a set of radially oriented sprocket teeth, said sets of sprocket teeth comprising said chain engaging means, said inboard ends of said hubs being releasably joined together by fastening means.

20. The structure claimed in claim 16 including a sprocket wheel coaxial with said spindles and located between said inboard spindle ends, said inboard ends of said hubs being releasably joined to said sprocket wheel, said sprocket wheel bearing radially oriented sprocket teeth, said sprocket teeth comprising said chain engaging means.

21. The structure claimed in claim 16 wherein each of said means at the outboard end of each of said spindles for shifting said idler assembly comprises a cylinder and a piston therein, one of said cylinder and said piston being slidable with respect to the other between a fully retracted position and a fully extended position, said slidable one of said cylinder and piston having a free end configured to engage an abutment surface on said mining machine, and means for introducing a fluid into said cylinders shifting means whereby to shift said idler assembly.

22. The structure claimed in claim 16 wherein each of said hubs bears an annular flange serving as a roller for said at least one chain, said inboard ends of said hubs being releasably joined together by fastening means.

23. The structure claimed in claim 16 including a wheel coaxial with said spindles and located between said inboard spindle ends, said inboard ends of said hubs being releasably joined to said wheel, said wheel bearing an annular flange serving as a roller for said at least one chain.

24. The structure claimed in claim 16 including means to make a fluid-tight seal between said inboard ends of said hubs, means to make a fluid-tight seal between each of said hubs and their respective spindles near the outboard ends of said hubs and means to intorduce a fluid lubricant between said hubs and their respective spindles.

25. The structure claimed in claim 19 wherein said mining machine has a single beam and a single trim chain, said trim chain being engaged by said sprocket teeth of both of said hubs.

26. The structure claimed in claim 19 wherein said cutting drum is rotatably supported at the ends of two beams mounted on said mining machine, said mining machine having two trim chains each passing about and cutting clearance for that portion of said one of said beams that support said cutting drums, each of said trim chains being engaged by said sprocket teeth of one of said hubs.

27. The structure claimed in claim 21 wherein each of said pistons is fixed to said outboard end of its respective spindle and its respective cylinder is slidable thereon between said fully retracted and fully extended positions, said means to maintain said idler assembly in adjusted position comprising at least one split ring affixed to each piston between said cylinder thereon and said spindle end mounting said piston.

28. The structure claimed in claim 21, wherein each of said cylinders comprises a part of its respective spindle and said pistons are slidable within their respective cylinders between said fully retracted and fully extended positions, said free ends of said pistons each terminate in an enlarged foot, said means to maintain said idler assembly in adjusted position comprises at least one split ring affixed to each piston between said foot of said piston and the forward end of said cylinder mounting said piston.

29. The structure claimed in claim 27 including first and second types of split rings for use with each piston, said first type comprising a split ring having planar parallel faces, a width between said faces representing a convenient increment of adjustment, an internal diameter equal to the diameter of said pistons and ends spaced from each other by a distance slightly less than said diameter of said pistons, said second type comprising a split ring identical to said first type and including an integral arcuate lug adapted to fit between said ends of said first type and being of a thickness equal to the width of said first type whereby when more than one split ring is required for each piston a ring of the first type is first applied to each piston followed by a ring of the second type to more equally distribute compressive forces applied to said rings by the adjacent ones of said piston feet and cylinder forward ends.

30. The structure claimed in claim 28 including first and second types of split rings for use with each piston, said first type comprising a split ring having planar parallel faces, a width between said faces representing a convenient increment of adjustment, an internal diameter equal to the diameter of said pistons and ends spaced from each other by a distance slightly less than said diameter of said pistons, said second type comprising a split ring identical to said first type and including an integral arcuate lug adapted to fit between said ends of said first type and being of a thickness equal to the width of said first type whereby when more than one split ring is required for each piston a ring of the first type is first applied to each piston followed by a ring of the second type to more equally distribute compressive forces applied to said rings by the adjacent ones of said piston feet and cylinder forward ends.

* * * * *

UNITED STATES PATENT AND TRADEMARK OFFICE

CERTIFICATE OF CORRECTION

PATENT NO. : 3,950,031

DATED : April 13, 1976

INVENTOR(S) : CLAUDE B. KREKELER

It is certified that error appears in the above-identified patent and that said Letters Patent are hereby corrected as shown below:

Column 10, line 9 after "would" insert be

Column 10, line 13 after "identical" insert to

In Claim 1, the first line of column 11, the word "sprocket" should read idler.

Claim 21, second to last line, the words "shifting means" should be deleted.

Claim 24, lines 5 and 6 the word "introduce" is incorrectly spelled.

Claim 26, line 6, the word "drums" should read drum.

Signed and Sealed this

Eighth Day of March 1977

[SEAL]

*Attest:*

RUTH C. MASON
*Attesting Officer*

C. MARSHALL DANN
*Commissioner of Patents and Trademarks*